United States Patent [19]

Weiss

[11] 3,981,444

[45] Sept. 21, 1976

[54] METHOD FOR STARTING A STEAM-HEATED HEAT EXCHANGER BY REGULATING THE PRESSURE OF THE HEATING-STEAM

[75] Inventor: Gerhard Weiss, Oberrohrdorf, Switzerland

[73] Assignee: BBC Brown Boveri & Company Limited, Baden, Switzerland

[22] Filed: May 29, 1975

[21] Appl. No.: 581,794

[30] Foreign Application Priority Data

Dec. 12, 1974 Switzerland ..... 16518/74

[52] U.S. Cl. ..... 236/1 R; 236/17; 165/40; 236/78 A

[51] Int. Cl.[2] ..... F24H 9/20

[58] Field of Search ..... 236/17, 1, 78; 165/40, 165/1

[56] References Cited

UNITED STATES PATENTS

| | | | |
|---|---|---|---|
| 1,988,348 | 1/1935 | Annin | 236/1 X |
| 3,126,053 | 3/1964 | Brunner | 165/40 |
| 3,131,863 | 5/1964 | Profos et al. | 165/40 X |

*Primary Examiner*—William E. Wayner

*Attorney, Agent, or Firm*—Pierce, Scheffler & Parker

[57] ABSTRACT

The invention involves a closed loop control method and apparatus for starting up a steam-heated heat exchanger by controlling the heating-steam pressure. According to the invention a correcting variable is established by a controller from an actual pressure value, measured by an actual value transmitter, and from a reference value, generated by a reference value generating device, the heating-steam pressure being modified by at least one control valve on the basis of said correcting variable. The pressure reference value S is selected from three pressure set values, $S_T$, $S_{P1}$ and $S_{P2}$, the lesser value of $S_T$ and $S_{P1}$ being established as an intermediate pressure set value S′ (that is, $S' = \text{Min}(S_T, S_{P1})$), and the pressure reference value S is selected as being the greater value of S′ and $S_{P2}$ (that is, $S = \text{Max}(S', S_{P2})$), where $S_T$ represents that permissible maximum desired pressure value which is a function of the momentary metal temperature $T_h$ of an endangered component of the heat exchanger, $S_{P1}$ represents that permissible maximum pressure set value which is a function of the momentary existing quantity of working medium and thus of the momentary existing power, and $S_{P2}$ represents the permissible minimum pressure set value as a function of the same momentary factor.

17 Claims, 4 Drawing Figures

METHOD FOR STARTING A STEAM-HEATED HEAT EXCHANGER BY REGULATING THE PRESSURE OF THE HEATING-STEAM

The invention concerns a closed loop control method for starting a steam-heated heat exchanger by controlling the heating-steam pressure, wherein a correcting variable is established by a controller from an actual pressure value, formed by a pressure transmitter, and from a pressure reference value, generated by a set value generating device, and wherein the heating-steam pressure is modified by at least one control valve on the basis of said correcting variable. The invention is concerned, also, with an apparatus for carrying out this method in practice.

A steam-heated heat exchanger comprises a container and a bundle of tubes embedded in one or several tube plates. The working medium, in liquid or gaseous form, is heated up from an initial temperature to a final temperature by heat delivered, by the heating steam, through the tube walls. These temperatures and the quantity of the working medium can vary as a function of time.

The starting of such a heat exchanger causes a number of problems. First, certain requirements should be met concerning the working medium and its desired final temperature which must neither fall below nor go beyond a certain limit, even if only a partial quantity of the working medium is present. Secondly it should be possible to start the heat exchanger very rapidly without creating any undue temperature stresses which could damage components of the heat exchanger.

One known arrangement, mentioned in BBC-Beschreibung R 20 789, which is designed to overcome these problems, employs an open loop control system wherein a linear signal which takes into account the maximum permissible pressure as a function of the quantity of the working medium, controls the stroke of a valve in accordance with an empirically determined function. This arrangement fails to employ a closed loop control, in other words, it does not use any feedback, and the variation in the steam pressure, and of the steam quantity, is accomplished solely by a change in valve stroke and the duration of the starting period depends only on the highest permissible increase in quantity of the working medium. The result is that the heat exchanger can be started up too rapidly. The resulting values of heating-steam pressure and heating-steam quantity occur without proper consideration of the lowest permissible pressure as a function of the quantity of the working medium, and of the pressure permissible in view of the temperature stresses within the endangered components of the heat exchanger. Therefore, the starting-up of the heat exchanger is not an optimum operation, and unduly high temperature stresses will occur within the endangered components of the heat exchanger, especially in the tube plates and/or the tube bundles, stresses which will cause damage to these components.

It is an object of the invention to overcome the disadvantages of the known open loop method of controlling the start-up of a steam-heated exchanger, and to establish a closed loop control method of the above-described type which takes into consideration first the highest and the lowest permissible steam pressure as a function of the working medium quantity, and secondly the metal temperature of the endangered component of the heat exchanger, and which finally adjusts the steam pressure in such manner that an almost optimum start of the heat exchanger becomes feasible so far as the duration of the starting period and economy are concerned.

The invention solves this problem in such manner that the pressure reference value S is selected from three pressure set values $S_T$, $S_{P1}$ and $S_{P2}$, the lesser value of $S_T$ and $S_{P1}$ being established as an intermediate pressure set value S′, in other words $S' = \text{Min}\ (S_T, S_{P1})$, and the pressure reference value S is selected from S′ and $S_{P2}$, whichever is greater, in other words $S = \text{Max}\ (S', S_{P2})$, where $S_T$ represents that permissible maximum pressure set value which is a function of the momentary metal temperature $T_h$ of the endangered component, $S_{P1}$ represents that permissible maximum pressure set value which is a function of the momentary existing quantity of working medium and thus of the momentary existing power, and $S_{P2}$ represents the permissible minimum pressure set value as a function of the same momentary factor.

An apparatus for the practical application of the method of the invention is characterized by an $S_{P1}$ generator to generate the desired pressure set value $S_{P1}$, an $S_{P2}$ generator to generate the pressure set value $S_{P2}$, and an $S_T$ function generator to generate the pressure set value $S_T$, — a smallest value selector, connected between the $S_{P1}$ generator and the $S_T$-function generator, to generate the intermediate pressure set value S′, and a largest value selector, connected between the smallest value selector and the $S_{P2}$ generator, to generate the pressure reference value S.

The various species of the invention differ in the manner by which the $S_T$ pressure set values are being provided. In particular, $S_T$ pressure set value can be provided on the basis of two measured metal temperature values, one being measured at a hot point and the other at a cold point of the endangered component, their difference not being allowed to exceed a certain permissible temperature difference. The $S_T$ pressure set value can also be provided on the basis of a time-dependent pressure function or a time-dependent temperature function, where permissible values of pressure or temperature gradients must not be exceeded. The devices proposed for the practical application of the method meet any other special requirements satisfactorily and make possible a safe and trouble-free operation at a relatively low expenditure.

The method proposed by the invention offers the following advantages:

The open loop arrangement used heretofore is replaced by a closed loop control system wherein the pressure reference value, which is fed into the controller for the establishment of a correcting variable, is selected from three different pressure set values, one taking into consideration the lowest permissible heating-steam pressure as a function of the working medium quantity, the second highest permissible heating steam pressure as a function of the working medium quantity, and the third the temperature stresses within the endangered component of the heat exchanger. Due to this arrangement there firstly are avoided any damages caused by stresses in the endangered component of the heat exchanger and, secondly, there is guaranteed an almost optimum starting-up operation of the heat exchanger so far as the duration of the starting period and economy are concerned. In other words, the heating of the working medium is accomplished neither too rapidly nor too slowly.

In the case of one preferred species of the invention, there are measured the actually existing metal temperatures so that each starting-up operation is accomplished in a specific, but always optimum manner based on the actual, momentary existing conditions. In the case of other species of the method, each starting-up operation takes place on the basis of assumed and calculated values, without actually measuring existing temperatures. However, the starting-up operation will still be almost at an optimum.

Species of the invention are explained below by means of the accompanying drawing, in which.

Identical components are denoted by identical reference numerals in the various figures.

Figure 1:
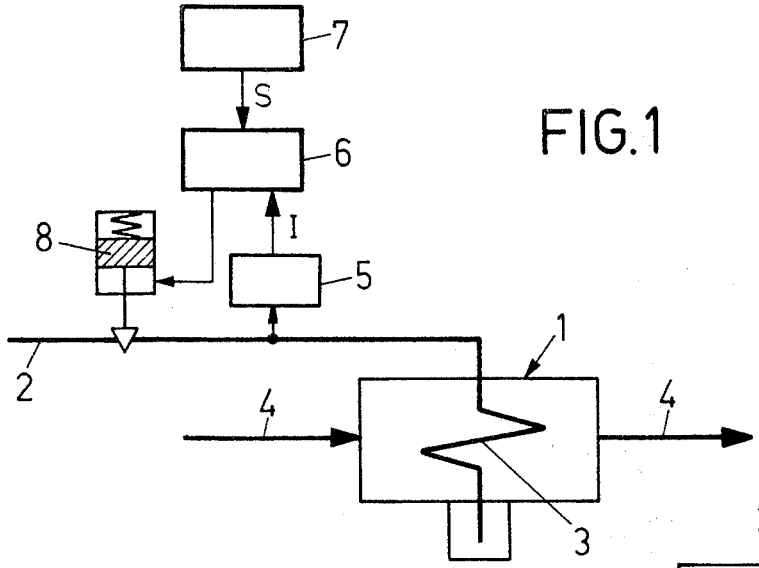
FIG. 1 shows an arrangement for the closed loop control of the steam pressure of a steam-heated heat exchanger in diagram form, with one actual value transmitter, one reference value generator, one controller and one control valve.

FIG. 1 shows an arrangement for the closed loop control of the pressure of heating steam delivered to a heat exchanger 1, an arrangement which is known per se. The heating steam is supplied to the tube bundles 3 of the heat exchanger 1 by way of steam piping 2 and will heat up the working medium which is flowing through by way of pipe 4. The actual pressure value of the heating steam is measured within the piping 2 in front of the tube bundles 3 by means of a pressure measuring device 5, and that measurement is fed into a controller 6. The controller 6, into which is also fed a reference value by a reference value generator 7, computes a correcting variable and transmits this value to a valve 8, located within the piping 2 in front of the pressure measuring device 5, which will move on the basis of the correcting variable, thus modifying the heating steam pressure as required. The arrangement of FIG. 1 shows a scheme which is generally valid for closed loop pressure control devices. The various species of the invention follow the same scheme, and they differ only in the manner in which the pressure refernce value S, — to be fed into the controller 6, — is established, and by the devices which perform the establishment of this value S.

In the case of all species of the method of the invention the pressure reference value S is selected from three pressure set values $S_T$, $S_{P1}$ and $S_{P2}$. The smaller value of $S_T$ and $S_{P1}$ is determined and used as intermediate pressure set value S', in other words $S' = \text{Min}\ (S_T, S_{P1})$, and the pressure set value S is chosen from S' and $S_{P2}$, whichever is greater. In other words, $S = \text{Max}\ (S', S_{P2})$. $S_{P1}$ represents the permissible maximum pressure set value as a function of the momentary present quantity of working medium, and thus of the momentary existing power, and is provided by an $S_{P1}$ function generator 9, provided for this purpose. $S_{P2}$ represents, on the other hand, the permissible minimum pressure set value as a function of the momentary present quantity of working medium, and thus of the momentary existing power, and is provided by an $S_{P2}$ function generator 10, provided for this purpose.

The pressure set value $S_T$ is the permissible maximum pressure value as a function of the momentary metal temperature $T_h$ of the endangered component, and it is derived in various manners by the different species as will be described below. Common to all species, however, are (1) a smallest value selector 12, connected between the $S_{P1}$ generator 9 and the $S_T$ generator 11, which establishes the intermediate pressure set value S' from $S_T$ and $S_{P1}$, whichever is smaller, and (2) a largest value selector 13, connected between the smallest value selector 12 and the $S_{P2}$ generator 10, which selects the pressure reference value S as the greater of the values S' and $S_{P2}$. This pressure reference value S is then fed into the controller 6 which computes the correcting variable from the difference: actual value I minus reference value S, and transmits the resultant value to the valve 8.

As has been mentioned above, the permissible maximum pressure set value $S_T$, which is a function of the momentary metal temperature $T_h$ of the endangered component, is derived in various manners by the different species of the invention. The preferred species, illustrated in FIG. 2, uses a measuring device 15 which measures the temperature $T_h$ at the hot point of the tube plate 14, and a measuring device 16 which measures the temperature $T_k$ at the cold point of the tube plate 14. A differencing element 17, following the temperature-measuring devices, derives the difference $\Delta T = T_h - T_k$ and transmits it to the $S_T$ limiter 19 which latter follows the differencing element 17. A $\Delta T_{zul}$ generator 18, connected to the $S_T$ limiter 19, feeds into the limiter the permissible temperature difference $\Delta T_{zul}$, resulting from the permissible temperature stress within the tube plate 14. The $S_T$ limiter 19 compares the value $\Delta T$ with the value $\Delta T_{zul}$ and generates a pressure set value $S_T$ in accordance with the results of this comparison.

In particular, if $\Delta T$ is smaller than $\Delta T_{zul}$ and therefore no need to consider temperature stresses when determining the heating steam pressure, the $S_T$ limiter 19 will generate a pressure set value $S_T$ of constant, maximum magnitude, for example 10 V, which will also be equivalent to the maximum value of $S_{P1}$, so that the value $S_{P1}$ will pass through the smallest value selector 12 and the heating steam pressure will be adjusted only in consideration of the momentary present quantity of the working medium. However, if the difference $\Delta T$ is greater than $\Delta T_{zul}$, — in other words, if the temperature stresses within the tube plate 14 exceed the permissible stress, the pressure set value $S_T$ is reduced in proportion to the deviation of the difference $\Delta T$ from the permissible difference $\Delta T_{zul}$, in such a way that in the normal case $S_{P1} > S_T \geqslant S_{P2}$, so that the reduced pressure set value $S_T$ will now reach the controller by way of the devices 12 and 13 and lower the heating steam pressure until $\Delta T$ again becomes equal to $\Delta T_{zul}$, in other words, until the temperature stresses within the tube plate 14 drops again to the permissible stress value.

If indicated, the $S_T$ limiter 19 is followed by a $B_T$ limiter 26. The latter generates a set point value $S_A$ as a function of the difference $S_T - S_{P2}$, which is used to reduce the load gradient of the working medium quantity if the reduced pressure set value $S_T$ is smaller than $S_{P2}$.

Figure 3:
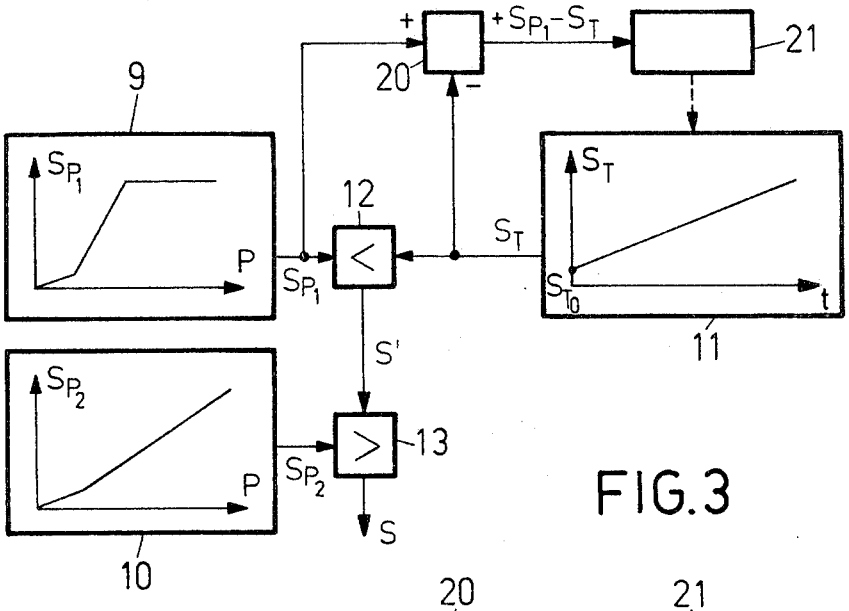
FIG. 3 shows a set value generator which is similar to the generator of FIG. 2 but which generates the $S_T$ pressure set value on the basis of a computed pressure function.

FIG. 3 shows an $S_T$ generator 11, placed in front of, and connected to, the smallest value selector 12, which device generates the pressure set value $S_T$ as a function of the time $t$, based on a minimum pressure set value $S_{To}$, calculated for the time $t = 0$ and which can likewise equal zero, and on at least one permissible pressure gradient $\Delta p/\Delta t$ which is selected in consideration of a permissible temperature gradient $\Delta T/\Delta t$ which shall not be exceeded. If one single pressure gradient $\Delta p/\Delta t$ is being used, the function $S_T = F(t)$ becomes a linear function. However, if several different pressure gradients are used, the function $S_T = F(t)$ becomes a function of several sections where each section possesses a different pressure gradient $\Delta p/\Delta t$ but selected in consideration of the temperature gradient $\Delta T/\Delta t$, which is not to be exceeded. If a sufficiently large number of such sections are used, the function $S_T = F(t)$ may be made to take on a shape corresponding to a permissible constant temperature gradient $\Delta T/\Delta t$.

FIG. 3 shows, further, a summing element 20 connected between the $S_{P1}$ generator 9 and the $S_T$ generating device 11, and a limit value indicator 21 connected between the summing element 20 and the $S_T$ generating device 11. The summing element 20 derives the algebraic sum $\Delta S = +S_{P1} - S_T$ and transmits it to the limit value indicator 21. The indicator 21 tests the sum $\Delta S$ as to its sign and influences the $S_T$ generating device 11 in such manner that if $\Delta S > 0$, — that is if $S_{P1} > S_T$, — the time t of the $S_T$ generating device will continue to run and the pressure set value $S_T$ will increase correspondingly, but if $\Delta S = 0$ (that is, if $S_{P1} = S_T$) said time t is stopped and the pressure set value $S_T$ is maintained constant, and if $\Delta S < 0$ (that is, if $S_{P1} < S_T$) the pressure set value $S_T$ will take on the value of the pressure set value $S_{P1}$.

Figure 4:
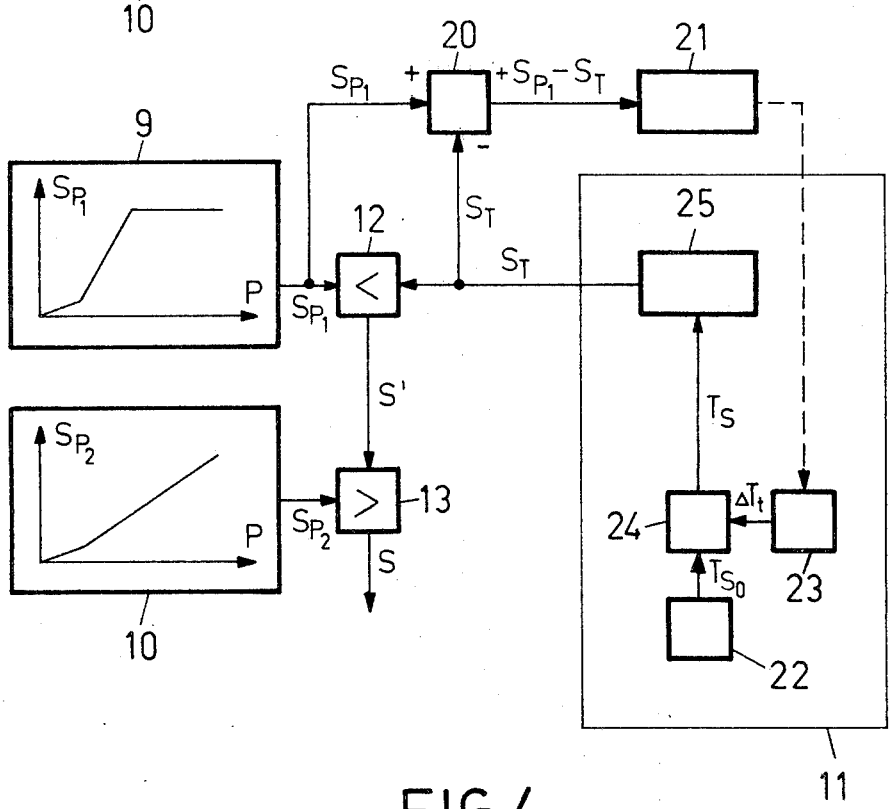
FIG. 4 shows another generator, similar to that of FIG. 2, which, however, generates the $S_T$ pressure set value from a temperature set value which is determined on the basis of a computed temperature function.

FIG. 4 shows the arrangement of a $T_o$ generator 22 which furnishes an initial minimum temperature set value $T_{So}$, valid for the time t = o. There also is provided an integrator 23 which computes the permissible temperature increase $\Delta T_t = t \cdot \Delta T/\Delta t$, valid for the time $t$, based on a permissible temperature gradient $\Delta T/\Delta t$, as a function of the permissible temperature stress. A summing element 24 is connected between the $T_o$ generator 22 and the integrator 23, and it calculates the sum $T_S = T_o + \Delta T_t$, which represents the temperature set value $T_S$ for the time $t$. An $S_T$-function generator 25, following the summing element 24, converts the temperature set value $T_S$, representing the saturated steam temperature, — to a corresponding pressure set value $S_T$, which in turn is transmitted to the smallest value selector 12.

FIG. 4 shows a summing element 20, connected between the $S_P$ generator 9 and the $S_T$ function generator 25, and a limit value indicator 21, connected between the summing element 20 and the integrator 23. The summing element 20 derives the algebraic sum $\Delta S = +S_{P1} - S_T$ and transmits it to the limit value indicator 21. This latter indicator tests the sum $\Delta S$ as to its sign, and it influences the integrator 23 in such manner if $\Delta S > 0$, — that is if $S_{P1} > S_T$, — the integrator 23 will continue to run and the pressure set value $S_T$ will further increase correspondingly, furthermore that if $\Delta S = 0$ (that is, if $S_{P1} = S_T$), the integrator 23 will be stopped and the pressure set value $S_T$ be maintained constant, but if $\Delta S < 0$, — that is, if $S_{P1} < S_T$, — the pressure set value $S_T$ will take on the value of the set value $S_{P1}$.

I claim:

1. Closed loop control method for starting a steam-heated heat exchanger by controlling the heating-steam pressure, where a correcting variable is established by a controller from an actual pressure value, measured by an actual pressure transmitter, and from a reference value generated by a reference value generating device and where the heating-steam pressure is modified by at least one control valve on the basis of said correcting variable, the characteristics being that the pressure reference value S is selected from three pressure set values $S_T$, $S_{P1}$ and $S_{P2}$, that the lesser value of $S_T$ and $S_{P1}$ is established as an intermediate pressure set value S′, that is $S' = \text{Min}(S_T, S_{P1})$, and the pressure reference value S is selected as being the greater value of S′ and $S_{P2}$, that is $S = \text{Max}(S', S_{P2})$, where $S_T$ represents that permissible maximum pressure set value which is a function of the momentary metal temperature $T_h$ of the endangered component (14) where $S_{P1}$ represents that permissible maximum pressure set value which is a function of the momentary existing quantity of working medium and thus of the momentary existing power, and where $S_{P2}$ represents the permissible minimum pressure set value as a function of the same momentary factor.

Figure 2:
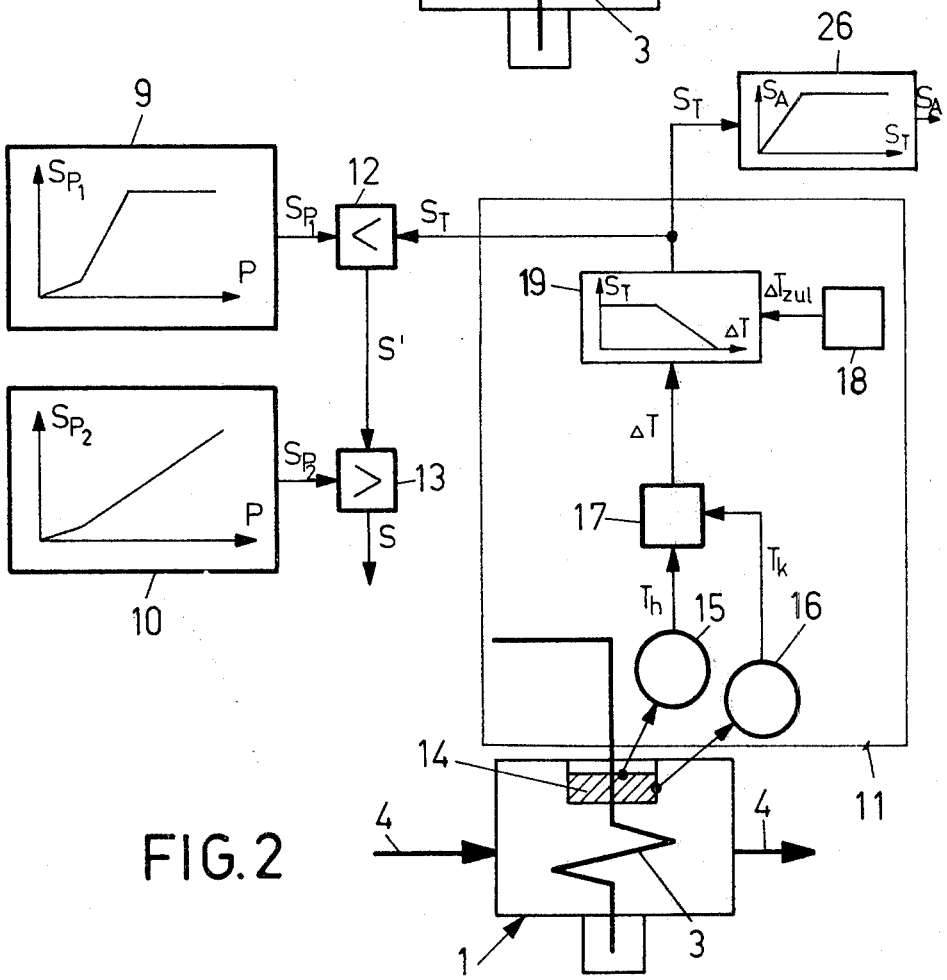
FIG. 2 illustrates one set value generator which computes the $S_{P1}$ and $S_{P2}$ pressure set values from corresponding functions of the working medium quantity and the $S_T$ pressure set value, based on two measured temperature values.

2. Method according to claim 1, in which the pressure set values $S_{P1}$ and $S_{P2}$ and generated from generating function which furnish the maximum permissible pressure set value as a function of the working medium quantity and thus the power P (FIGS. 2,3,4).

3. Method according to claim 1, which comprises measuring the temperature $T_h$ at the hot point, and the temperature $T_k$ at the cold point of the endangered component, computing the difference $\Delta T = T_h - T_k$ and comparing said difference with a permissible temperature difference $\Delta T_{zul}$, based on the permissible temperature stresses, and generating a pressure set value $S_T$, based on the result of this comparison (FIG. 2).

4. Method according to claim 3, according to which if the difference $\Delta T$ is smaller than the permissible $\Delta T_{zul}$, a pressure set value $S_T$ of constant, maximum value is produced, but if the difference $\Delta T$ is greater than the permissible difference $\Delta T_{zul}$, the pressure set value $S_T$ is reduced in proportion to the deviation of the difference $\Delta T$ from the permissible difference $\Delta T_{zul}$ and the heating-steam pressure is decreased in accordance with the reduced desired pressure value $S_T$ until $\Delta T$ again becomes equal to $\Delta T_{zul}$ (FIG. 2).

5. Method according to claim 4, according to which if the reduced pressure set value $S_T$ becomes smaller than $S_{P2}$, the load gradient of the working medium quantity is reduced in accordance with the set value $S_A$, formed on the basis of the difference $S_T - S_{P2}$ (FIG. 2).

6. Method according to claim 1, in which the pressure set value $S_T$ is derived on the basis of a minimum pressure set value $S_{To}$, calculated for the time $t = 0$ and which can likewise equal zero, and on the basis of at least one permissible pressure gradient $\Delta p/\Delta t$ selected in such a way, that a permissible temperature gradient $\Delta T/\Delta t$ dependent on the permissible temperature stress shall not be exceeded (FIG. 3).

7. Method according to claim 1, according to which there is generated a temperature set value $T_S$, based on an initial, minimum temperature set value $T_{So}$, valid for the time $t = 0$, and a permissible temperature gradient $\Delta T/\Delta t$ as a function of the permissible temperature stress, that is $T_S = T_{So} + \Delta T/\Delta t\ t$,
and the temperature set value $T_S$ is reconverted to a pressure set value $S_T$ (FIG. 4).

8. Method according to claim 1, wherein a difference $\Delta S = + S_{P1} - S_T$ is formed and tested as to its sign, and the results of this test produce the effect that if $\Delta S > 0$, the time t, which advances in formation of the pressure set value $S_T$ will continue to run and the pressure set value $S_T$ will continue to increase correspondingly, but if $\Delta S = 0$, the time t is stopped and the pressure set value $S_T$ is maintained constant, and if $\Delta S < 0$, the pressure set value $S_T$ will take on the value of the pressure set value $S_{P1}$ (FIGS. 3,4).

9. Apparatus for carrying out the method set forth in claim 1, which comprises: a $S_{P1}$ generator (9) generating the pressure set value $S_{P1}$; a $S_{P2}$ generator (10) generating the pressure set $S_{P2}$; a $S_T$ generating device (11) generating the pressure set value $S_T$; a smallest value selector (12) connected between the $S_{P1}$-generator (9) and the $S_T$-generating device (11), providing an intermediate pressure set value S'; and a largest value selector (13) connected between the smallest value selector (12) and the $S_{P2}$ generator (10) and generating a pressure reference value S (FIGS. 2,3,4).

10. Apparatus according to claim 9, further comprising a measuring device (15) to measure the temperature $T_h$ at the hot point of the endangered component (14), a measuring device (16) to measure the temperature $T_k$ at the cold point of the endangered component (14), and a differencing element (17), following the temperature-measuring devices (15,16) deriving the difference $\Delta T = T_h - T_k$ (FIG. 2).

11. Apparatus according to claim 10, further comprising a $S_T$ limiter (19), connected between the differencing element (17) and the smallest value selector (12), and a $\Delta T_{zul}$-generator (18), connected to the $S_T$-limiter (19), the $\Delta T_{zul}$-generator (18) being used to derive and transmit to the $S_T$ limiter (19) a permissible temperature difference $\Delta T_{zul}$ based on the permissible temperature stress, the $S_T$ limiter (19) being provided to compare the difference $\Delta T = T_h - T_k$ with the permissible temperature difference $\Delta T_{zul}$ and to generate a pressure set value $S_T$ based on the result of this comparison (FIG. 2).

12. Apparatus according to claim 11, which comprises a $B_T$ limiter (26), following the $S_T$ limiter (19), for effecting any necessary reduction in the load gradient of the working medium quantity (FIG. 2).

13. Apparatus according to claim 9, wherein the $S_T$-generating device (11) connected to a smallest value selector (12) is used to derive the pressure set value $S_T$ as a function of the time $t$, based on a pressure set value $S_{To}$, valid for the time $t = 0$, and on at least one permissible pressure gradient $\Delta p/\Delta t$, selected in consideration of a permissible temperature gradient $\Delta T/\Delta t$ (FIG. 3).

14. Apparatus according to claim 9, which further comprises a summing element (20), connected between the $S_{P1}$ generator (9) and the $S_T$-generating device (11) and being used for computing the algebraic sum $\Delta S = + S_{P1} - S$, furthermore a limit value indicator (21) connected between the summing element (20) and the $S_T$-generating device (11) and being used for testing the algebraic sum $\Delta S = + S_{P1} - S_T$ as to its sign and establishing a pressure set value $S_T$ based on the result of said test (FIG. 3).

15. Apparatus according to claim 9, further comprising a $T_o$ generator (22) generating an initial minimum temperature set value $T_{So}$, valid for the time $t = 0$, an integrator (23) computing a permissible temperature increase $\Delta T_t = t^k \cdot \Delta T/\Delta t$, valid for the time $t$, and summing element (24), connected between the $T_o$ generator (22) and the integrator (23), and calculating the sum $T_S = T_o + \Delta T_t$, the desired temperature value for the time $t$ (FIG. 4).

16. Apparatus according to claim 15, in which a $S_T$ function generator (25) is connected to the summing element, and reconverts the temperature set value $T_S$ representing a saturated steam temperature, to a pressure set value $S_T$(FIG. 4).

17. Apparatus according to claim 9, in which a summing element (20) is connected between the $S_{P1}$ generator (9) and the $S_T$ function generator (25) and computes the algebraic sum $\Delta S = S_{P1} - S_T$, and in which a limit value indicator (21) is connected between the summing element (20) and the integrator (23) and tests the algebraic sum $\Delta S = + S_{P1} - S_T$ as to its sign to establish a pressure set value $S_T$ based on the result of this test (FIG. 4).

* * * * *